US007618137B2

(12) United States Patent
Inoue

(10) Patent No.: US 7,618,137 B2
(45) Date of Patent: Nov. 17, 2009

(54) INK JET RECORDING SYSTEM, INK CARTRIDGE AND INK JET RECORDING APPARATUS

(75) Inventor: Hiroshi Inoue, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 518 days.

(21) Appl. No.: 11/505,343

(22) Filed: Aug. 17, 2006

(65) Prior Publication Data

US 2007/0040875 A1 Feb. 22, 2007

(30) Foreign Application Priority Data

Aug. 19, 2005 (JP) ..... 2005-238923

(51) Int. Cl.
*B41J 2/175* (2006.01)

(52) U.S. Cl. ..... 347/86; 347/93

(58) Field of Classification Search ..... 347/85–87, 347/93

See application file for complete search history.

(56) References Cited

U.S. PATENT DOCUMENTS 6,045,207 A * 4/2000 Mochizuki et al. ..... 347/7
6,332,481 B1 * 12/2001 Shinada et al. ..... 141/18
6,539,985 B2 * 4/2003 Shinada et al. ..... 141/2

FOREIGN PATENT DOCUMENTS

JP 08-183185 A 7/1996

* cited by examiner

*Primary Examiner*—An H Do
(74) *Attorney, Agent, or Firm*—Birch, Stewart, Kolasch & Birch, LLP

(57) ABSTRACT

An ink outlet and a pushing pin are formed on the bottom of a case of an ink cartridge. A fine-textured filter is put on inside of the ink outlet. A carriage is provided with an ink holding section at an upper end of an ink supply tube and a pressing section that is connected to the ink supply tube. As the ink cartridge is mounted on the carriage, a porous member of the ink holding section is pressed onto the filter, whereas the pushing pin pushes the pressing section to deform elastically. Then pressure inside the ink supply tube is raised to feed the ink reversely into the porous member, so the ink inside the ink supply tube is joined to the ink inside the case, reducing pressure loss through the filter.

10 Claims, 4 Drawing Sheets

INK JET RECORDING SYSTEM, INK CARTRIDGE AND INK JET RECORDING APPARATUS

FIELD OF THE INVENTION

The present invention relates to an ink jet recording system consisting of an ink jet recording apparatus having an ink jet type recording head and an ink cartridge containing an ink to be supplied to the recording head.

BACKGROUND OF THE INVENTION

An ink jet recording apparatus has been known, which has a recording head for discharging ink as droplets onto a recording medium to print an image. The ink jet recording apparatus is provided with at least an ink tank containing an ink, to supply the ink from the ink tank to the recording head. In a serial ink jet recording apparatus, a recording head is mounted to a carriage that moves back and forth in a main scanning direction, a widthwise direction of a recording paper. Each time the carriage makes one lap, the recording head records a line of image, and then the recording paper is fed in a sub scanning direction orthogonal to the main scanning direction by an amount corresponding to the image line. Thus, an image frame is printed serially line after line.

Because the ink is a consumable material, the ink tank is often formed as a cartridge that is removably attached to the ink jet recording apparatus, so as to make it easy to refill the ink jet recording apparatus with the ink. Such a cartridge type ink tank, hereinafter called the ink cartridge, is attached to the carriage in association with the recording head.

The ink jet recording apparatus has an ink supply path that leads to the recording head. As the ink cartridge is attached to the carriage, an ink outlet of the ink cartridge is connected to one end of the ink supply path. Thus, the ink cartridge can supply the ink to the recording head. As an example, the ink supply path is constituted of a hollow ink supply needle. The ink outlet is provided with a filter made of a porous material like sponge, and one end of the ink supply needle is stuck into the filter.

As the ink cartridge is detached from the carriage, the ink supply needle is pulled out of the filter. At that time, dusts are likely to enter inside the ink cartridge through the ink outlet. To prevent the entrance of dusts, an ink cartridge as disclosed for example in Japanese Laid-open Patent Application No. Hei 8-183185, is provided with a valve that is pushed by the ink supply needle to open the ink outlet. As the ink cartridge is detached and the ink supply needle is removed from the ink outlet, the valve closes the ink outlet. In addition to that, the ink cartridge of this prior art sections an ink chamber into a main chamber and a sub chamber, wherein the sub chamber directly leads to the ink outlet, and a filter is disposed between the sub chamber and the main chamber. Thereby, dusts are surely blocked from the main chamber.

However, because the ink cartridge should be mounted on the carriage to move with the carriage, the ink cartridge is expected to be as small as possible. Also, because the ink cartridge is a consumable product that should be changed after the contained ink is used up, the structure of the ink cartridge is desired to be as simple as possible to save the cost. Since the ink cartridge of the above mentioned prior art is provided with the valve, and is sectioned into two chambers, it is difficult to make it small and simple.

An easy way to prevent the entrance of dusts into the ink cartridge is disposing a filter of finer texture in the ink outlet. But the finer is the filter, the larger pressure loss through the filter becomes, which results in requiring the stronger sucking power of the recording head for sucking the ink out of the ink cartridge. Proving the recording head with the stronger sucking power will increase the cost of the recording head itself.

SUMMARY OF THE INVENTION

In view of the foregoing, a primary object of the present invention is to provide an ink jet recording system consisting of an ink jet recording apparatus and an ink cartridge, which prevents dusts from entering the ink cartridge while permitting minimizing and simplifying the ink cartridge, and without the need for a stronger sucking power of the recording head.

According to an ink jet recording system of the present invention, which consists of an ink jet recording apparatus having an ink jet type recording head and an ink cartridge removably attached to the ink jet recording apparatus, the ink jet recording apparatus comprises an ink supply path that leads to the recording head, an ink holding section for absorbing and holding the ink by its capillary force, the ink holding section being located at an outer end of the ink supply path and having a contact surface exposed to outside, and a pressing section connected to the ink supply path at a position between the ink holding section and the recording head; and the ink cartridge comprises a case containing ink to be supplied to the recording head, an ink outlet to be connected to the ink supply path, a filtering porous member for filtering the ink as flowing through the ink outlet, the filtering porous member being located at the ink outlet with one surface exposed to outside the case, and a pushing member for pushing the pressing section. As the ink cartridge is attached to the ink jet recording apparatus, the exposed surface of the filtering porous member comes into tight contact with the contact surface of the ink holding section, and the pushing member pushes the pressing section to apply pressure to the ink inside the ink supply path, thereby to send the ink into the ink holding section and connect the ink inside the ink supply path to the ink in the case through an interface between the exposed surface of the filtering porous member and the contact surface of the ink holding section.

According to a preferred embodiment, the pressing section has a storage chamber for storing a portion of the ink drawn from the ink supply path. The storage chamber has a variable volume that is reduced as the pushing member pushes the pressing section, to pressurize the ink in the ink supply path.

The pressing section preferably comprises a body having the storage chamber and an opening, and an elastic member that covers the opening to close the storage chamber tightly, the opening being located in a position facing to the pushing member when the ink cartridge is attached to the ink jet recording apparatus. The elastic member is pushed to be deformed elastically by the pushing member, reducing the volume of the storage chamber.

Preferably, the pushing member is a pin whose one end is fixed to the case and the other end is a free end at which the pin pushes the pressing section. The pin has a length that the free end comes into contact with the pressing section before the filtering porous member comes into contact with the ink holding section when the ink cartridge is attached to the ink jet recording apparatus.

According to a preferred embodiment, the ink holding section comprises an ink holding porous member that absorbs and holds the ink, and a tubular holder holding the ink holding porous member. An exposed surface of the ink holding porous member constitutes the contact surface of the ink holding section, and protrudes out of the holder, so the ink holding porous member is crushed when the exposed surface of the filtering porous member is pressed onto the contact surface, causing the ink to ooze out of the contact surface into the exposed surface of the filtering porous member.

According to the present invention, as the ink cartridge is attached to the ink jet recording apparatus, the ink inside the ink supply path is connected to the ink in the case through the interface between the exposed surface of the filtering porous member and the contact surface of the ink holding section. So the pressure loss at the filtering porous member is lessened when the ink is supplied from the ink cartridge to refill the recording head. Therefore, the filtering porous member may have smaller holes to improve preventive effect against dust, while achieving smooth supply of the ink to the recording, without the need for enhancing the sucking power of the recording head.

BRIEF DESCRIPTION OF THE DRAWINGS

The above and other objects and advantages of the present invention will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
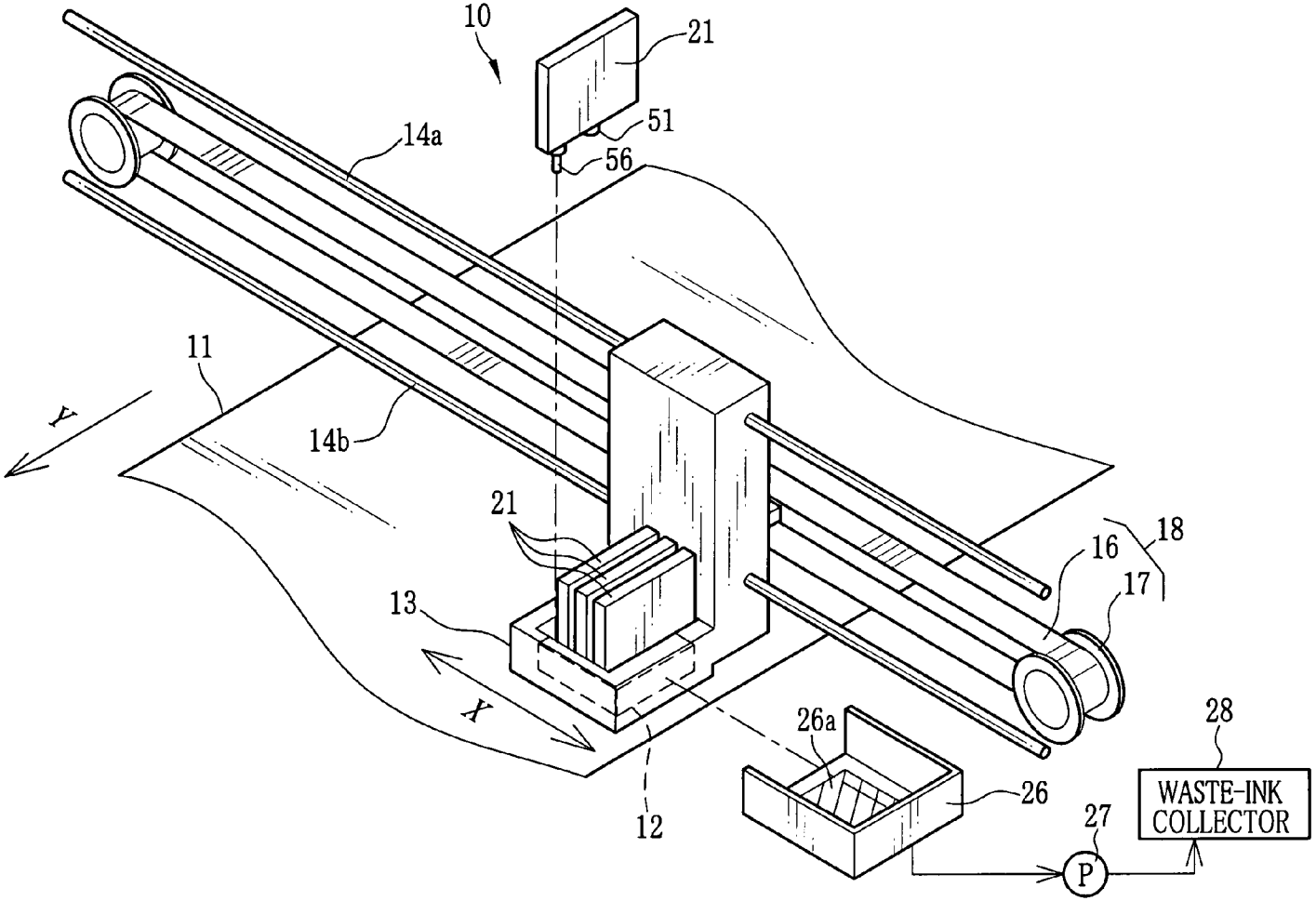
FIG. 1 is an explanatory diagram illustrating essential elements of an ink jet recording apparatus according to an embodiment of the invention.

An ink jet recording apparatus 10 shown in FIG. 1 is provided with a recording head 12 that discharges ink toward a recording paper 11 to print images thereon. The recording head 12 is provided with a plurality of not-shown nozzles for discharging the ink from individual outlets. The outlets of the nozzles are aligned in a plane to form a discharging surface, and the discharging surface is placed in face to a recording surface of the recording paper 11. The recording head 12 is mounted in a carriage 13 that is movable in a widthwise direction of the recording paper 11, that is, a main scanning direction X. The discharging surface is exposed through an opening formed through a bottom of the carriage 13. While reciprocating in the widthwise direction of the recording paper 11 together with the carriage 13, the recording head 12 records an image in a line sequential fashion. Each time the recording head 12 makes one lap to record a line of the image, the recording paper 11 is fed by not-shown conveyor rollers in a sub scanning direction Y, that is orthogonal to the main scanning direction X, by a length corresponding to a width of each image line as recorded by the recording head 12. Thus image is recorded line by line.

The carriage 13 is mounted on a pair of guide rods 14*a* and 14*b* to slide thereon, and is driven by a belt mechanism 18 consisting of a belt 16 and a pair of pulleys 17. The carriage 13 carries ink cartridges 21 that are easily removable, e.g. four cartridges containing inks of four different colors: yellow, magenta, cyan and black. The carriage 13 is provided with several slots 13*a* (see FIG. 3), into which the ink cartridges 21 are plugged.

The ink cartridge 21 is attached with its bottom toward the bottom surface of the slot 13*a*. When the ink cartridge 21 is attached to the carriage 13, the ink cartridge 21 and the recording head 12 are connected through the ink supply tube 64. In the recording head 12, oscillation plates are provided in one-to-one relationship with the nozzles. Each of the oscillation plates is driven individually by a piezoelectric element, to change the pressure. The pressure change causes the ink to be sucked out of the ink cartridge 21 into the nozzle, and discharged from the outlet of the nozzle.

The carriage 13 is evacuated and waits out of the conveyor path of the recording paper 11, when it is not in recording motion. This waiting place is the home position of the carriage 13, and the ink cartridge 21 can be exchanged at this home position. At this home position, a head cap 26 covering a discharging surface from its bottom is placed in order to receive the ink leaked out of the discharging surface. In face to the discharging surface of the head cap 26, a sucking surface 26*a* is placed in order to suck out ink clogged in the outlets of the nozzles. The head cap 26 is connected to a suction pump 27, which works at the time of recovery from a discharging defect of the recording head 12 by sucking the ink clogged in the nozzles through the sucking surface 26*a*. The ink recovered by the suction pump 27 goes to a waste-ink collector 28.

Figure 2:
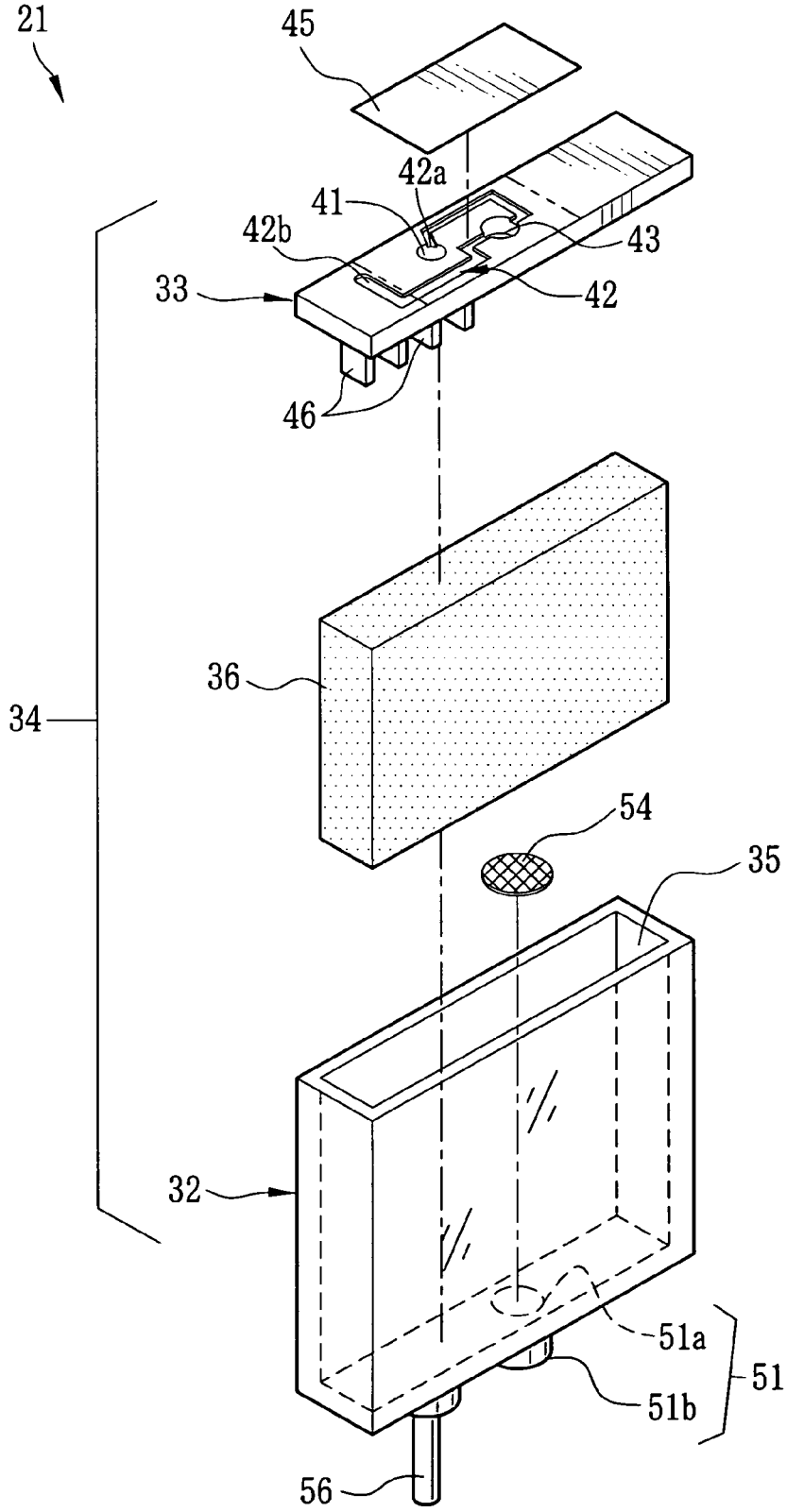
FIG. 2 is an exploded perspective view of an ink cartridge used in the ink jet recording apparatus of FIG. 1.

As shown in FIG. 2 the ink cartridge 21 has a case 34 containing ink. This case 34 consists of a case body 32 which is formed with an ink chamber 35 for ink storage and a lid 33 for closing an open top of the case body 32. The lid 33 is affixed to the case body 32, for example, by welding, after the case body 32 is filled with the ink. The case body 32, for example, is formed from a transparent plastic or the like, so the remaining amount of the ink in the ink cartridge 21 is visible from outside.

The ink chamber 35 holds an ink absorbent 36 which absorbs and keeps ink. The ink absorbent 36 is made of a spongy material having micro holes that generate a capillary force. Concretely, the ink absorbent 36 is made of a porous material, including a foamed material like urethane foam, or a fibrous material like felt. The ink absorbent 35 has a width and a depth, which are approximately equal to a width and a depth of the ink chamber 35, so the ink absorbent 36 is contained in the ink chamber 35 with its peripheral surfaces, except the top surface, in contact with inner wall surfaces of the ink chamber 35.

The case 34 is placed over the recording head 12 so that the weight of an ink inside of the case 34 works as a positive pressure toward the recording head 12. Due to its capillary force, the ink absorbent 36 absorbs and holds the ink, and also generates a negative pressure in the nozzles of the recording head 12 relative to the atmosphere. Thus, keeping the pressure in the recording head 12 negative to the atmosphere prevents the ink from unexpectedly leaking out of the outlets of the nozzles.

The lid 33 is formed with an air inlet 41 for sending the air into the ink chamber 35 in correspondence with the consumption of the ink. The lid 33 also has a meander groove 42 formed on its top side. One end 42*a* of the groove 42 is connected to the air inlet 41, and a liquid sink 43 is formed on a path from the end 42*a* to a second end 42*b*. A section of the groove 42 exclusive of the second end 42*a*, i.e. the section between phantom lines in FIG. 2, is covered from the top with a seal 45, so the second end 42*b* alone is exposed to the atmosphere. The groove 42 leads the ink to the liquid sink 43, if the ink leaks out of the ink chamber 35 through the air inlet 41. So the ink is prevented from leaking out of the ink cartridge 21. The air is introduced from the second end 42*b* into the air inlet 41.

A plurality of ribs 46 protruding downward are formed on the bottom side of the lid 33.

As the lid 33 is attached to the case body 32, the ribs 46 protrude into the ink chamber 35 and come into contact with a top surface of the ink absorbent 36, pressing down the ink absorbent 36 onto the bottom of the ink chamber 35. Thereby, the ink absorbent 36 is fixedly positioned to provide a room between the ink absorbent 36 and the lid 33, preventing the ink absorbent 36 from being displaced to close the air inlet 41.

On the bottom surface of the case 34, an ink outlet 51 is placed in order to take the ink out of the ink chamber 35, to feed the ink to the recording head 12. The ink outlet 51, for example, consists of an oval opening 51*a* formed at the bottom of the ink chamber 35 and a cylindrical protrusion 51*b* protruded downward from the opening 51*a*. On the bottom surface of the ink chamber 35, a filter 54 as a substantially plane plate is arranged at the place where the opening 51*a* is formed. A bottom surface of the filter 54 is exposed through the ink outlet 51. This bottom surface will be called an exposed surface 54*a*.

The filter 54, which is a filtering porous member, filters the ink taken to the outside through the ink outlet 51*a*. When a sucking pressure by the recording head 12 is not present, the filter 54 prevents the ink inside of the case 34 from running outside. Moreover, when the sucking pressure by the recording head 12 is present, the filter 54 allows the ink to path through it and run out of the case 34. For this purpose, the porous member is used. The porous member has many small holes, which allow ink to path through them and, at the same time, form ink menisci with their capillary force, generating the force to hold the ink therein. The present example of the filter 54 is a mesh filter in which many small holes are aligned in meshes. The installment of the filter 54 prevents a solidified ink inside of the ink chamber 35 or a foreign object from flowing into the recording head 12. Preferably, the diameter of the small holes of the filter 54 is between 5 μm and 20 μm. The filter 54 with such small holes created by micromeshes can surely prevent any dust and dirt from penetrating into the ink chamber 35.

However, in the use of the fine-textured filter 54, the ink is held by the filter 54 itself, which forms the ink menisci with the capillary force at the small holes of the filter 54. Therefore, when the ink cartridge 21 is not attached to the ink recording apparatus 10, the ink inside of the case 34 is separated from the atmosphere outside of the case 34 at the filter 54 acting as a boundary. This is called the vapor-liquid separation. In order for the ink inside of the case 34 to be taken out into the ink supply tube 64 through the filter 54, a large sucking power that breaks the ink menisci is necessary. Therefore, the present invention, the ink cartridge 21 and the ink jet recording apparatus 10, has the ingenuity to lessen the pressure loss at the filter 54 when the ink cartridge 21 is attached to the ink jet recording apparatus 10.

At the bottom surface of the case 34, there is a pushing pin 56 whose one end is fixed on the case 34, and whose other end reaches down to be a free end. As will be described later, the pushing pin 56 is a pushing member that constitutes a member of an ink pressurizing system, which pressurizes ink toward the ink supply tube 64, to generate the adverse current toward the case 34 in opposition to the supplying direction toward the recording head 12, and send the ink toward the filter 54 from the ink supply tube 64. By sending the ink from the ink supply tube 64 toward the filter 54, the ink inside of the ink supply tube 64 and the ink in the case 34 are connected to each other, so the pressure loss of the filter 54 is lessened.

Figure 3:
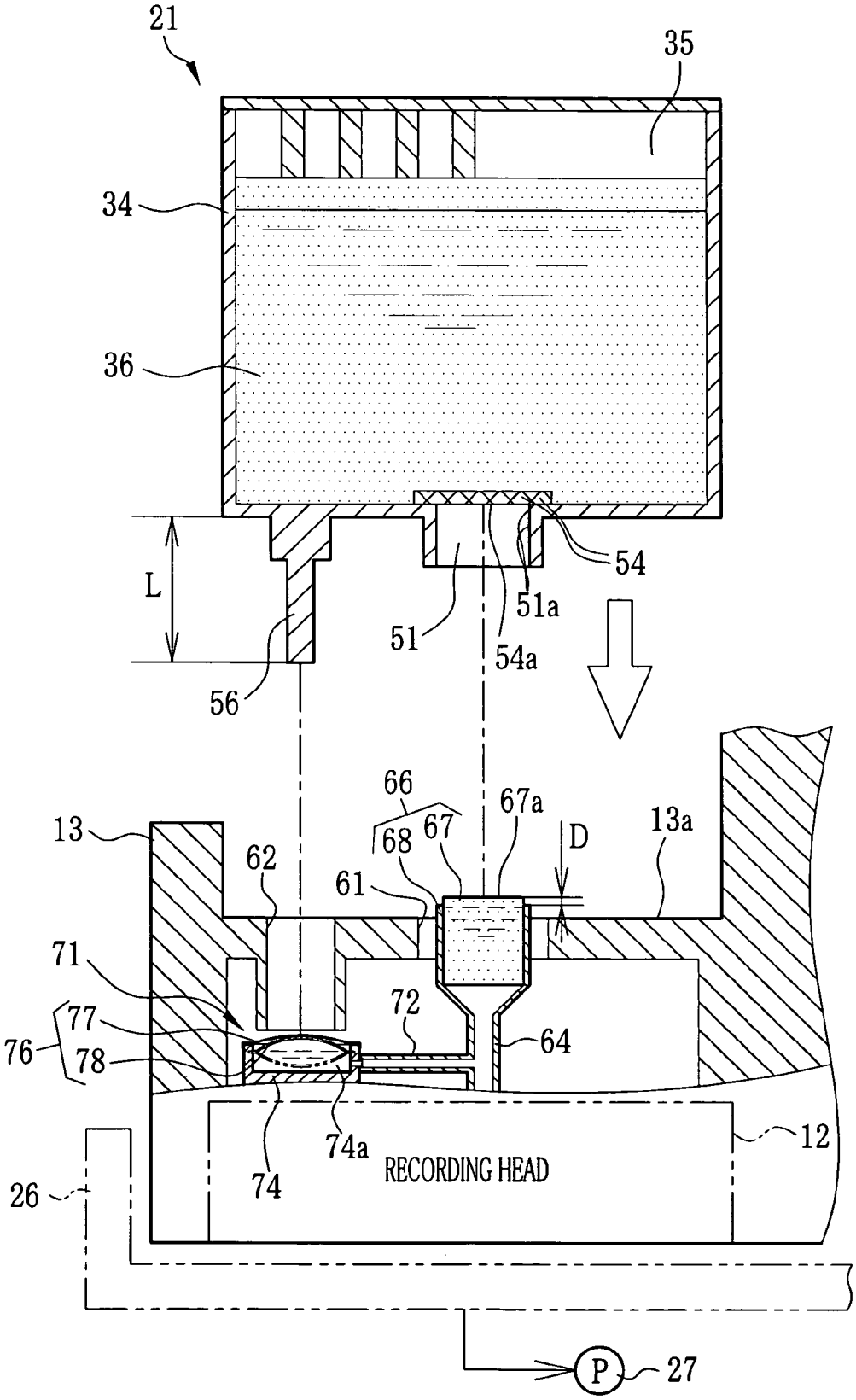
FIG. 3 is an explanatory diagram illustrating joint portions between the ink cartridge and a carriage.

As shown in FIG. 3, at each slot 13*a* of the carriage 13, openings 61 and 62 are formed and respectively positioned in face to the ink outlet 51 and the pushing pin 56. In the opening 61, an ink holding section 66 is arranged to be connected to the ink outlet 51. The ink holding section 66 is set at the end of the ink supply tube 64 that constitutes the ink supply path toward the recording head 12.

The ink holding section 66 consists of a holding porous member 67 that absorbs and keeps the ink, hereinafter simply called as the porous member, and a tubular holder 68 that holds the porous member 67. The ink holding section 66 absorbs the ink inside of the ink supply tube 64 with the capillary force of the porous member 67, and holds the ink at the end of the ink supply tube 64 on the connecting side to the ink outlet 51. As for the porous member 67, the similar spongy material to the ink absorbent 36 is used.

When the ink cartridge 21 is attached to the carriage 13, the protrusion 51*b* of the ink outlet 51 is inserted into the carriage 13 through the opening 61, such that the protrusion 51*b* embraces the ink holding section 66, and the exposed surface 54*a* of the filter 54 is brought in to contact with a contact surface 67*a*, the upper surface of the porous member 67.

The porous member 67 is arranged as to protrude upward from the holder 68. That is, the upper part of the porous member 67, including the contact surface of 67*a*, protrudes by a length D from the upper end face of the holder 68. This arrangement allows the exposed surface 54*a* of the filter 54 to be pressed against the contact surface 67*a*, and to crush the porous member 67 gently. When the porous member 67 is crushed, the absorbed ink flows from the contact surface 67*a* toward the exposed surface 54*a*. Thus, the ink is sent through the filter 54 to the inside of the case 34, so the ink contents in the ink supply tube 64 and the ink chamber 35 are connected to each other. Thereby, the ink flow resistance through the filter 54 is lessened.

In order to let the ink ooze out of the porous member 67 to the extent that the ink contents in the ink supply tube 64 and the ink chamber 35 can be connected to each other, the ink must be amply absorbed in the porous member 67 for its moist state. For this purpose, the carriage 13 is provided with a pressing section 71. As being pushed by the pushing pin 56, the pressing section 71 pressurizes the ink inside of the ink supply tube 64 to send the ink toward the ink holding section 66. The pressing section 71 is connected through a connecting tube 72 to the ink supply tube 64 at a position between the ink holding section 66 and the recording head 12. The pressing section 71 together with the pushing pin 51 makes the ink pressurizing system.

Through the connecting tube 72, the pressing section 71 draws the ink from the ink supply tube 64, and stores the drawn ink. The pressing section 71 is positioned in face to the individual opening 62 where the pushing pin 51 of each ink cartridge 21 is inserted. The pressing section 71 consists of a body 74 formed with a storage chamber 74*a* for storing the ink and an elastic section 76 that covers an upper opening of the body 74. The elastic section 76, for example, consists of a flexible thin film 77 that seals up the storage chamber 74*a* and a plate spring 78 that biases the film 77 to enlarge the volume of the storage chamber 74*a*. The elastic section 76 is elastically deformed to reduce the volume of the storage chamber 74*a*, when it receives the pressure from the pushing pin 56, as shown by dashed-two dotted line in FIG. 3. Herewith, the stored ink runs into the ink supply tube 64 through the connecting tube 72, and the ink inside of the ink supply tube 64 is pressurized.

This pressure makes a part of the ink inside of the ink supply tube 64 run toward the recording head 12 in the supplying direction of the ink supply tube 64 and, at the same time, other part of the ink runs toward the ink holding section 66 oppositely to the supplying direction. Thereby, the ink is sent to the porous member 67. When the ink cartridge 21 is attached, because the head cap 26 caps over the recording head 12, the ink menisci in the nozzles are not broken, even when the ink runs toward the recording head 12, so the ink does not leak out of the discharging surface. Even if the ink menisci are broken so that the ink leaks out of the nozzles, the head cap 26 receives the leaked ink, and collects it to the waste-ink collector 28.

In addition, when the ink cartridge 21 is removed from the carriage 13, and the pressure of the pushing pin 56 is released, the elastic part 77 of the pressing section 71 comes back to the default position. At that time, the storage chamber 74*a* is enlarged and draws the ink inside of the ink holding section 66 again into the pressing section 71. Therefore, when the ink cartridge 21 is removed, the ink is prevented from leaking or dispersed out of the ink holding section 66.

It is preferable that the ink running action into the porous member 67 starts before the exposed surface 54*a* of the filter 54 contacts to the contact surface 67*a* of the porous member 67. The reason is as follows: if the ink does not ooze out of the contact surface 67*a* before the contact between the contact surface 67*a* and the exposed surface 54*a*, there will be a gap in the interface between the contact surface 67*a* and the exposed surface 54*a* when these surfaces are pressed against each other. Such a gap will make it difficult to send the ink into the filter 54. Therefore, the pushing pin 56 has such a length L that the pushing pin 56 comes to push the elastic section 76 before the filter 54 comes into contact with the porous member 67. Thus, the exposed surface 54*a* gets the contact with the contact surface 67*a* after the ink oozes out of the contact surface 67*a*.

Figure 4A:
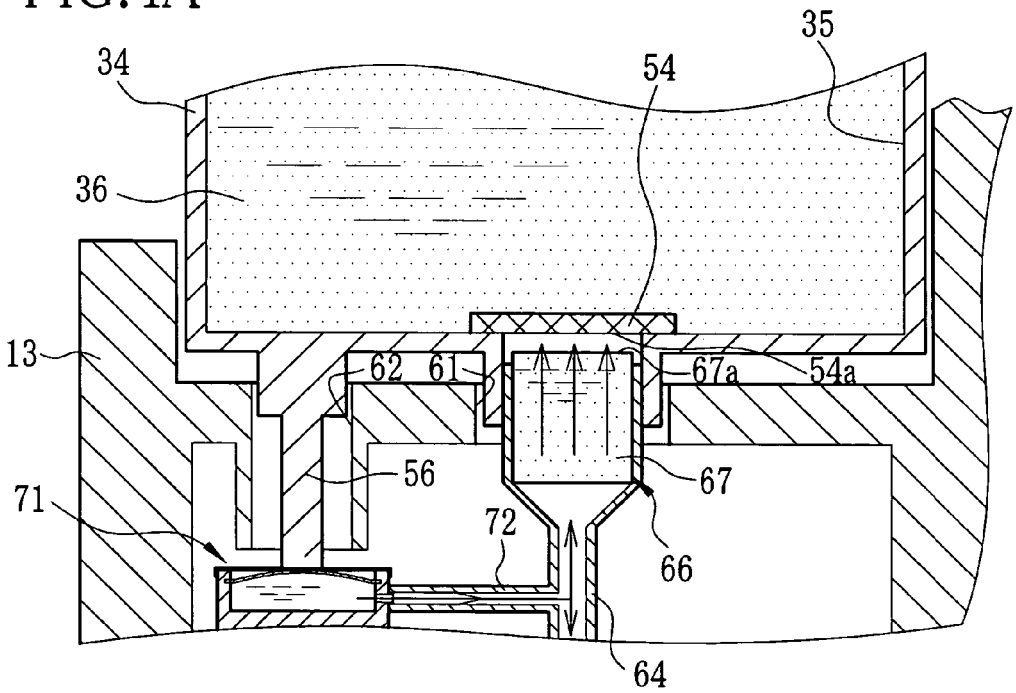
FIGS. 4A and 4B are explanatory diagrams illustrating how the ink cartridge is attached to the carriage.
Figure 4B:
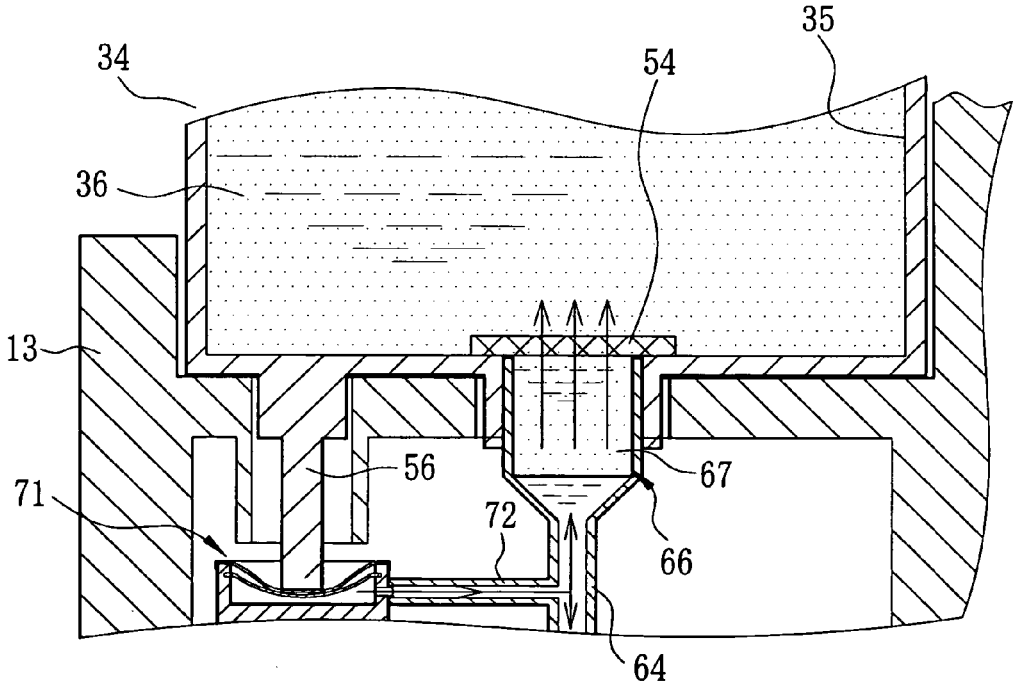

Now the operation of the above-described embodiment will be explained with reference to FIG. 4. To attach the ink cartridge 21 to the carriage 13, the ink cartridge 21 is lowered with the bottom surface of the case 34 toward the carriage 13 and inserted into the slot 13*a*. As shown in FIG. 4A, the ink outlet 51 goes into the opening 61, and the pushing pin 56 goes into the opening 62 respectively.

Before the exposed surface 54*a* of the filter 54 contacts to the contact surface 67*a* of the porous member 67, the pushing pin 56 contacts to the pressing section 71, and starts pushing. Herewith, the ink inside of the ink supply tube 64 is pressurized, so the ink is sent to the ink holding section 66. Thereby, the porous member 67 becomes amply moist, and the ink oozes out of the contact surface 67*a*.

In addition, when the case 34 is pushed inside of the slot 13*a*, the exposed surface 54*a* contacts to the contact surface 67*a*, and the exposed surface 54*a* is pressed against the porous member 67 to crush it. Herewith, more ink oozes out of the contact surface 67*a* and ink is sent to the filter 54, and therefore through the interface between the contact surface 67*a* and the exposed surface 54*a*, the ink contained in the case 34 and the ink existing in the ink supply tube 64 are connected to each other.

When the recording head 12 starts its recording motion, ink is drawn from the ink cartridge 21 through the ink supply tube 64, to refill the recording head 12 with the ink by an amount corresponding to the discharged amount of ink from the recording head 12. As the ink in the case 34 is connected to the ink in the ink supply tube 64, the pressure loss through the filter 54 is lessened, so that the recording head 12 can be refilled with the ink with a little force.

Note that it is preferable to fill the ink storage chamber 74*a* with the ink before shipment of the ink jet recording apparatus 10. With the pressing section 71 being filled with the ink at the shipment, the above-described operation is possible at the first attachment of the ink cartridge 21.

The diameter of the micro holes of the filter 54 as recited in the above-described embodiment is just one example, and may be out of the above-mentioned range, that is, the filter meshes can be finer or coarser than the above-mentioned range. Also, the above-mentioned operation is explained with the application of the mesh filter, but a filter can be made of such a porous member as felt that generates the ample capillary force for the vapor-liquid separation or as a thin membrane formed of sintered polyethylene with water repellent finishing, which is a synthesized polyethylene material made under the high temperature and pressure.

In addition, the structure of the above-mentioned pressing section is one example and several different modifications are possible. For example, a dropper-like rubber bag can form a pressing section. Also, in the above-mentioned embodiment, the pushing pin directly pushes the pressing section. But a cooperation mechanism can be provided between the pushing pin and the pressing section, so as to push the pressing section indirectly. Moreover, instead of the plate spring, an elastic member such as a sponge can be installed inside the storage chamber of the pressing section. This prevents leakage of the ink out of the storage chamber even if the thin film is broken.

Moreover, the above-described embodiment relates to a case where the ink cartridge is used with its ink outlet oriented downward. However, the present invention is applicable to those cases where an ink cartridge is used with its ink outlet oriented upward or to one side. Although the ink cartridge is located above the recording head in the above-described embodiment, the ink cartridge can be arranged otherwise. If an ink cartridge is arranged below a recording head, the weight of ink inside of the ink cartridge is not loaded on the recording head, so it is not necessary to provide an ink absorbent for generating a negative pressure inside a cartridge case.

Thus, the present invention is not to be limited to the above-described embodiments but, on the contrary, various modifications will be possible without departing from the scope of claims appended hereto.

What is claimed is:

1. An ink jet recording system comprising an ink jet recording apparatus having an ink jet type recording head and an ink cartridge removably attached to said ink jet recording apparatus, wherein:

said ink jet recording, apparatus comprises:

an ink supply path that leads to said recording head, an ink holding section for absorbing and holding the ink by its capillary force, said ink holding section being located at an outer end of said ink supply path and having a contact surface exposed to outside, and a pressing section connected to said ink supply path at a position between said ink holding section and said recording head; and said ink cartridge comprises:

a case containing ink to be supplied to said recording head, an ink outlet to be connected to said ink supply path, a filtering porous member for filtering the ink as flowing through said ink outlet, said filtering porous member being located at said ink outlet with one surface exposed to outside said case, and a pushing member for pushing said pressing section, wherein, as said ink cartridge is attached to said ink jet recording apparatus, said exposed surface of said filtering porous member comes into tight contact with said contact surface of said ink holding section, and said pushing member pushes said pressing section to apply pressure to the ink inside said ink supply path, thereby to send the ink into said ink holding section and connect the ink inside said ink supply path to the ink in said case through an interface between said exposed surface of said filtering porous member and said contact surface of said ink holding section.

2. An ink jet recording system as claimed in claim 1, wherein said pressing section has a storage chamber for storing a portion of the ink drawn from said ink supply path, said storage chamber having a variable volume that is reduced as said pushing member pushes said pressing section, to pressurize the ink in said ink supply path.

3. An ink jet recording system as claimed in claim 2, wherein said pressing section comprises a body having said storage chamber and an opening, and an elastic member that covers said opening to close said storage chamber tightly, said opening being located in a position facing to said pushing member when said ink cartridge is attached to said ink jet recording apparatus, wherein said elastic member is pushed to be deformed elastically by said pushing member, reducing the volume of said storage chamber.

4. An ink jet recording system as claimed in claim 1, wherein said pushing member is a pin whose one end is fixed to said case and the other end is a free end at which said pin pushes said pressing section, said pin having a length that said free end comes into contact with said pressing section before said filtering porous member comes into contact with said ink holding section when said ink cartridge is attached to said ink jet recording apparatus.

5. An ink jet recording system as claimed in claim 1, wherein said ink holding section comprises an ink holding porous member that absorbs and holds the ink, and a tubular holder holding said ink holding porous member.

6. An ink jet recording system as claimed in claim 5, wherein an exposed surface of said ink holding porous member constitutes said contact surface of said ink holding section, and protrudes out of said holder, so said ink holding porous member is crushed when said exposed surface of said filtering porous member is pressed onto said contact surface, causing the ink to ooze out of said contact surface into said exposed surface of said filtering porous member.

7. An ink jet recording system as claimed in claim 1, wherein said filtering porous member is a plate-like mesh filter having a large number of micro holes arranged in meshes, wherein said micro holes have diameters ranging from 5 μm to 20 μm.

8. An ink jet recording system as claimed in claim 1, wherein said ink cartridge further comprises an ink absorbent that is contained in said case, and absorbs and holds the ink by its capillary force, to keep pressure inside said recording head negative to atmosphere while said ink cartridge is attached to said ink jet recording apparatus.

9. An ink cartridge removably attached to an ink jet recording apparatus having an ink jet type recording head, for supplying ink to said recording head through an ink supply path of said ink jet recording apparatus, said ink cartridge comprising:

a case containing the ink;

an ink outlet for feeding the ink out of said case;

a filtering porous member for filtering the ink as flowing through said ink outlet, said filtering porous member being located at said ink outlet with one surface exposed to outside said case; and a pushing member for pushing a pressing section of said ink jet recording apparatus, wherein, as said ink cartridge is attached to said ink jet recording apparatus, said exposed surface of said filtering porous member comes into tight contact with an ink holding porous member that is located in said ink supply path, and said pushing member pushes said pressing section to apply pressure to the ink inside said ink supply path, thereby to send the ink through said ink holding porous member into said filtering porous member.

10. An ink jet recording apparatus comprising:

an ink jet type recording head;

a cartridge mounting section for mounting at least an ink cartridge that contains ink to be supplied to said recording head;

an ink supply path provided in said cartridge mounting section, to connect said ink cartridge to said recording head;

an ink holding section located at an outer end of said ink supply path, said ink holding section having an ink holding porous member for absorbing and holding the ink by its capillary force, said ink holding porous member having a contact surface exposed to outside; and a pressing section connected to said ink supply path at a position between said ink holding section and said recording head, wherein, as said ink cartridge is attached to said cartridge mounting section, said contact surface of said ink holding porous member comes into tight contact with an exposed surface of a filtering porous member that is located in an ink outlet of said ink cartridge, and said pressing section is pushed by a pushing member of said ink cartridge, to apply pressure to the ink inside said ink supply path, thereby to send the ink into said ink holding section and connect the ink inside said ink supply path to the ink in said ink cartridge through an interface between said contact surface of said ink holding porous member and said exposed surface of said filtering porous member.

* * * * *